United States Patent [19]

Ewanus et al.

[11] 4,112,368

[45] Sep. 5, 1978

[54] CONSTANT AMPLITUDE CARRIER COMMUNICATIONS SYSTEM

[75] Inventors: Walter Ewanus, Ellicott City, Md.; Gerald F. Sage, Grand Rapids, Mich.

[73] Assignee: Westinghouse Electric Corp., Pittsburgh, Pa.

[21] Appl. No.: 54,259

[22] Filed: Jul. 13, 1970

[51] Int. Cl.[2] ..... H04K 1/00

[52] U.S. Cl. ..... 325/32; 325/40; 325/47; 325/65; 325/142

[58] Field of Search ..... 325/32, 34, 40, 47, 325/139, 142, 65

[56] References Cited

U.S. PATENT DOCUMENTS

| | | | |
|---|---|---|---|
| 3,350,644 | 10/1967 | McNair | 325/65 |
| 3,366,882 | 1/1968 | Briley | 325/142 |
| 3,406,343 | 10/1968 | Mehlman | 325/40 |
| 3,478,268 | 11/1969 | Coviello | 325/65 |

OTHER PUBLICATIONS

A.R.R.L., *Radio Amateur's Handbook* (31st ed. 1954), p. 101.

*Primary Examiner*—Howard A. Birmiel

*Attorney, Agent, or Firm*—F. H. Henson

[57] ABSTRACT

A communication system comprising one or more communication units (transceivers) in which the transmitter includes means for modulating the carrier wave in such manner that the carrier amplitude is not varied by signal information but nevertheless signal information content can be extracted by conventional amplitude-modulation detection at the receiver. The signal power spectrum is varied along the frequency axis due to angle or phase modulation. The main components of each unit includes a transceiver, antenna and a phase-reversal modulator-correlator module between the antenna and the transceiver. The modulator-correlator module is bidirectional in operation and therefore it further modulates a spectrum of any signals from the transceiver which are radiated from the antenna and likewise modulates the spectrum of any electromagnetic wave signals received by the antenna. The modulation performed in the receive mode is of such a form that the signal is transformed into conventional amplitude modulated carrier which can be demodulated by a normal narrow band receiver. The modulation performed at the receiver is a correlation process so that an intended receiver can be discretely addressed through a coding process.

10 Claims, 17 Drawing Figures

CONSTANT AMPLITUDE CARRIER COMMUNICATIONS SYSTEM

BACKGROUND OF THE INVENTION

1. Field of the Invention

This invention relates to a communication system comprising at least two communication units, each having the same functional characteristics, which provides discrete addressing, privacy and protection against interfering signals within the operating wave band.

In copending application Ser. No. 754,375 filed Aug. 21, 1968, in the name of Walter Ewanus, and identified in the files of the assignee as WE Case 38,667, there is described and claimed a communication system somewhat similar to the present system utilizing at least two communication units each having characteristics common to both, such as transceiver components, so that either can serve as a transmitter or receiver. In that application, as well as in the present instance, one of the important features is the arrangement of a high speed bidirectional modulator-correlator module between the antenna and the transceiver module. For purposes of simplification, because the device referred to hereinabove as a modulator-correlator is actually capable of performing the dual function, it will be referred to as a "modulator" module when the device is operating as a part of the transmitter and will be called a "correlator" module when the device is operating as a part of the receiver unit.

In both systems phase shift keying (PSK) modulation is used to spread the spectrum and since the modulator module is bidirectional it spreads the spectrum of the transmitted signals as well as undesired received signals. This function in conjunction with digital coding provides discrete addressing privacy and protection against unwanted interfering signals. Although the communication units are illustrated as being transceiver units, it is obvious that separate transmitter and receiver components may be substituted for the transceiver components.

In the system of the previously mentioned patent application, privacy is accomplished by superimposing the intelligence modulation directly on the carrier by any type of modulation in which the amplitude of the carrier remains constant, such as in phase, angle or frequency modulation. Pseudo-noise modulation is also applied to the modulation of the carrier for the purpose of further spreading the spectrum such that practically no signal power is within the aperture of a conventional receiver not employing the special modulator correlator module employed in the units of the system. In that system, if any modulation is used which causes the carrier amplitude to vary, a conventional AM receiver, which can overcome the processing gain by virtue of its close proximity to the transmitter, can recover the modulating intelligence by detecting the amplitude of the noise spectrum.

The present invention is an improvement over the system described in said patent application in that the present invention utilizes pulse width modulation in conjunction with pseudo-noise coded PSK, modulation so that the amplitude of the carrier, from the transmitter is constant and therefore a conventional receiver, although being close enough to pick-up sufficient carrier power cannot demodulate the signal intelligence from the resultant spectrum.

2. Description of the Prior Art

While spread-spectrum communication systems are well known, the advantages of the spread spectrum phenomena have not heretofore been fully realized because of the limitations placed upon the receiver. In the invention of the aforementioned patent application, as well as in the present application, a narrow band communication system is provided in which signals from a narrow band signal generator module are converted to broad-band signals in the wide band modulator module and are radiated from a broad-band radiating antenna. This broad-band module is reciprocal in operation and therefore serves as both a modulator for the transmitted signals from the transmitting unit and serves as a demodulator for signals received from the antenna of the other communications unit, Spectrum broadening takes place in the modulator module of the transmitting unit and correlation takes place in the corresponding module of the receiving unit operating as a correlator. Spectrum broadening is applied to any uncoded electromagnetic wave supplied to either end of the modulator module. When a properly coded electromagnetic wave spectrum is applied to one end of the module and the correct code is applied as the modulation input, the resultant output signal from the module becomes the original modulated carrier which can be demodulated by a conventional AM or FM demodulator. In both of these systems the only components of the unit which need be broad-band are the modulator module and the antenna. Consequently, conventional AM or FM communication units can be used with the modulator correlator modules.

Whereas in the system of the aforesaid patent application the extent of the spread of the spectrum is relied upon to provide the privacy, in the present invention the PSK and PWM modulation is utilized to provide a modulated carrier signal in which the signal power spectrum is varied along the phase or frequency axis due to angle or phase modulation while the transmitted carrier amplitude remains constant, thus vastly increasing the ability to discretely address particular receiver terminals, provide communications privacy and minimize communication interference.

SUMMARY OF THE INVENTION

As further distinguished from the aforesaid patent application where the carrier is first modulated by the intelligence signals and thereafter modulated by the digital code, preferably a pseudo-random noise code, in the present instance the intelligence signals pulse-width modulate a square wave in such a form that it varies the duty ratio of the pulses. The resultant binary pulse train is then used to create binary pulse modulation of the carrier to give zero and $\pi$ phase depending upon the state of the pulse train. In other words, the amplitude of the intelligence pulse-width modulates a square wave train and this resultant signal controls the coded PSK modulation of the carrier. The resultant is the typical phase reversal modulation of a sinusoid in the time domain as illustrated.

The modulated carrier is illustrated in FIG. 1 in an extremely large scale but it will be appreciated that the modulation of the pulse width modulated square wave plus the PSK modulation superimposed upon the carrier provides a very complex, modulated carrier signal and causes the intelligence components to be obscured by the code structure. The resultant transmitted spectrum will then have no amplitude modulation components since the basic modulation will then be constant amplitude digital phase modulation. Upon the reception of such a complex modulation signal by a properly coded correlator module the signal will be converted to amplitude modulation which can then be detected by a conventional AM receiving system.

The present invention provides a communication system including two or more of communication units each having the capability as serving in either a transmit or receive mode, as briefly described above. Each unit comprises a transceiver module, or components equivalent to a transceiver, and a broad-band antenna for both transmitting and receiving and the modulator-correlator module, previously discussed, interposed between the transceiver module and the antenna. Each must have in addition to the carrier generator, a suitable code generator for synchronizing and driving the modulator-correlator modules at the transmitter and receiver. Conventional amplitude modulated communication units having only a transceiver module and a broad-band antenna can be converted for use in the present system by the addition of the modulator module and the digital code generator which, of course, must include appropriate means for synchronizing it to the code generator of the other unit.

The basic modulation of the transmitter carrier is phase shift keyed modulation, commonly called PSK also illustrated in the time domain in FIG. 1. The PSK modulation is used in conjunction with pulse width modulation, commonly called PWM, which gives a constant amplitude carrier. The intelligence is placed on a square wave sub-carrier in the form of pulse width modulation. This in turn is combined with a digital pseudo-noise coder commonly called a PN coder. The resultant digital waveform is used to PSK modulate the RF carrier. The PSK modulation gives a PN coded, noise sideband, spread spectrum carrier signal having a constant amplitude in which a conventional AM receiver can demodulate the intelligence when the receiving unit is correlated with the transmitter.

There are several possible arrangements that can be utilized to accomplish the desired end result of the present invention, the preferred embodiment of the system being illustrated in FIG. 14 of the drawings. The basic PSK modulation of the transmitted carrier is a stream of groups of radio frequency sinusoid waves, each group of which has alternate zero and $\pi$ radians phases, as illustrated at A in FIG. 1. The pulse width modulation determines the time during which the carrier alternately remains in the zero and $\pi$ radians phase modes of operation as indicated in Curve B of FIG. 1.

For purposes of illustration it will be instructive to visualize how the modulation performs with only the duty ratio modulator acting on the carrier, that is, with the psuedo-noise mode being inoperative. The resultant carrier modulation is then a digital PWM modulation of the carrier when the states of the modulating waveform determines the phase of the PSK modulation of the carrier.

The frequency spectrum resulting from the PSK modulation and the PWM modulation, where the modulating frequency is a square wave with 50% duty cycle, gives an ideally suppressed carrier spectrum, illustrated in FIG. 2. For this unique case the 50% duty ratio corresponds to one extreme of the signal intelligence input. Now, taking the other extreme of the signal intelligence input, that is, 100% duty ratio, all of the energy is in the carrier, as illustrated in FIG. 3. Therefore, for the condition where the values of the modulating frequency represent conditions in between 50% duty ratio and 100% duty ratio, the content of the carrier component must be varied in between zero and 100%. For illustrative purposes FIG. 4 shows the spectrum for a duty ratio of 75%. It will be noted that since the intelligence signal is applied to the carrier only in terms of change in duty ratio there are no FM or AM signal components in the sidebands and there is nothing that affects the amplitude of the carrier and it remains constant for all conditions.

From this it will be seen that if a conventional AM receiver with selectivity chosen such that its bandwidth is less than the sub-carrier frequency (fm) the output response of an AM receiver will be a function of the duty ratio of the PWM wavetrain. The varying duty ratio, varied by the intelligence signal, provides only a very limited AM component in the bandpass of the AM receiver.

The PN modulation added to the PSK and the PWM modulations spreads the spectrum of the carrier and all of the sidebands are noise sidebands which makes it unrecognizable to any receiver equipment, whether it is AM or FM, when the received signals are not correlated with the transmitted signals. The conventional AM receiver responds to the signal power determined by the proper correlation of the signal and the amplitude of the carrier being constant before correlation, thereby denies the intelligence modulation to any receiver not having the correlating code.

BRIEF DESCRIPTION OF THE DRAWINGS

Referring now to the drawings for a more detailed description of the invention, FIG. 14 is a modular block circuit diagram of the system which comprises at least two communication units 10 and 11 which together constitute a communication system. Both of these units include basic transceiver modules 10-12 and 11-12', each of which includes respective modulator-correlator modules 10-20 and 11-20' which can be of identical construction. For illustrative purposes, it may be assumed that the two communication units are of identical construction, and therefore description of a feature in one is not repeated for the other. Because there is novelty in the units, per se, as well as in the communications system utilizing the units, description of one unit in the transmitting mode and the other in the receiving mode is presented. The unprimed reference numerals refer to components of the unit operating in the transmitting mode and the primed numbers refer to components of the unit operating in the receiving mode. It will be obvious to those skilled in the art that instead of identical transceiver modules as illustrated separate transmitters and receiver components capable of performing the equivalent functions may be used.

The communications units have antennas 10-21 and 11-21', respectively, with broadband operating characteristics, as is illustrated in some detail in the background material of the copending patent application. When the communication system operates in the normal mode, say for example, when the transmitter of the unit 10 is transmitting PSK modulation of radio frequency energy a signal spectrum is produced which includes the sum and difference frequency components and the envelope is a (sin X)/$x$ voltage curve, or a $[(\sin X)/x]^2$ power spectrum curve, the envelope of which is illustrated in dotted line in FIG. 6.

At this point it will be helpful to discuss the types of modulation used in the present communication system.

Figure 1:
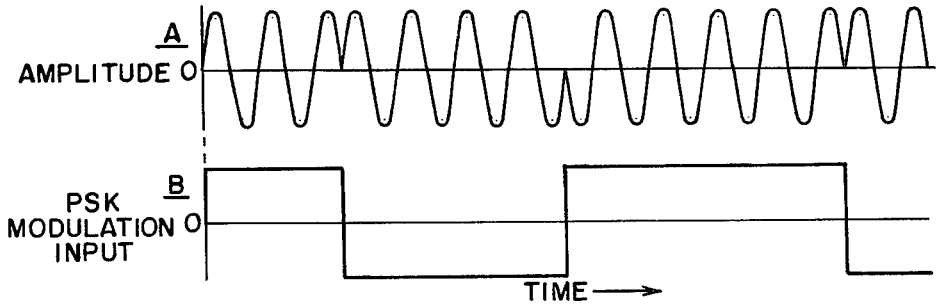
FIG. 1 illustrates PSK modulation and PWM modulation and the phase relations between these two modulations in accordance with the present invention — Curve A representing the PSK modulation and Curve B representing the PWM modulation.

The basic modulation placed on the carrier is the phase shift keyed type, commonly called PSK modulation. FIG. 1 illustrates the digital phase modulation of a carrier where a carrier is shifted 0° or 180°, depending upon the state of the digital signal. The intelligence could be contained in the digital sequence through coding techniques, such as by analog to digital conversion, or the digital signal could be pulse-width modulated (PWM) by an analog signal. In either instance the digital signal is combined with a digital pseudo-random code signal using digital logic techniques, such as modulo-2 addition, for example. The resultant of the combined digital signal, is then utilized to modulate the RF carrier as shown in FIG. 1 to produce a PSK modulated carrier. By the addition of the pseudo-random code, an unintended receiver cannot extract the intelligence as can an intended receiver. The intended receiver, through a correlation process, and after synchronization, removes the pseudo-random code structure so that the intelligence can be extracted using conventional demodulation techniques, such as AM demodulation.

Figure 2:
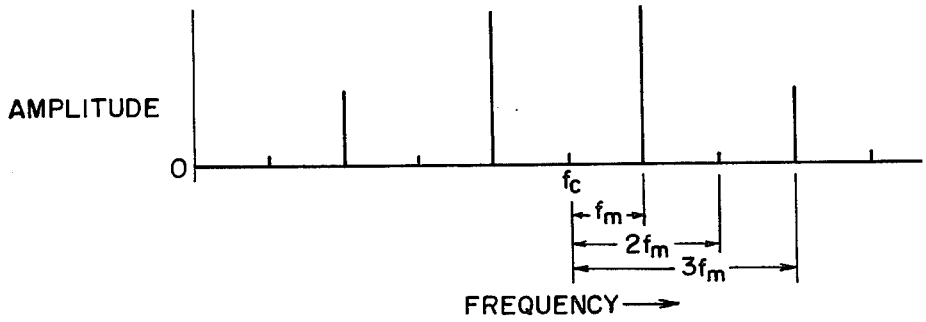
FIG. 2 is a graphical representation of the spectrum resulting from a carrier being modulated by square wave pulses at 50% duty ratio giving ideally suppressed carrier modulation.

Specifically, for this case, the use of PWM modulation to introduce the intelligence signal causes discrete sideband energy in the frequency spectrum as shown in FIG. 2. This spectrum will be observed by the intended receiver after the correlation process, i.e., after the pseudo-noise code has been removed. Normal AM demodulation will then recover the intelligence when the receiver bandwidth is just wide enough to admit the carrier energy, centered at the frequency $f_c$, plus the necessary bandwidth to admit the intelligence sidebands. The receiver bandwidth should not be large enough to admit the discrete sidebands generated by the subcarrier frequency, fm.

At the transmitting end the intelligence signals on the carrier are supplied to a pulse width modulator in such a manner that it varies the duty ratio in accordance with the amplitude of the intelligence signals and this duty ratio signal determines the time variations in the phase reversals of the carrier represented in the graph A of FIG. 1. As is clearly seen from this curve, this creates binary phase modulation of the carrier of alternately zero and $\pi$ radians phase depending upon the state of the pulse train.

Figure 17:
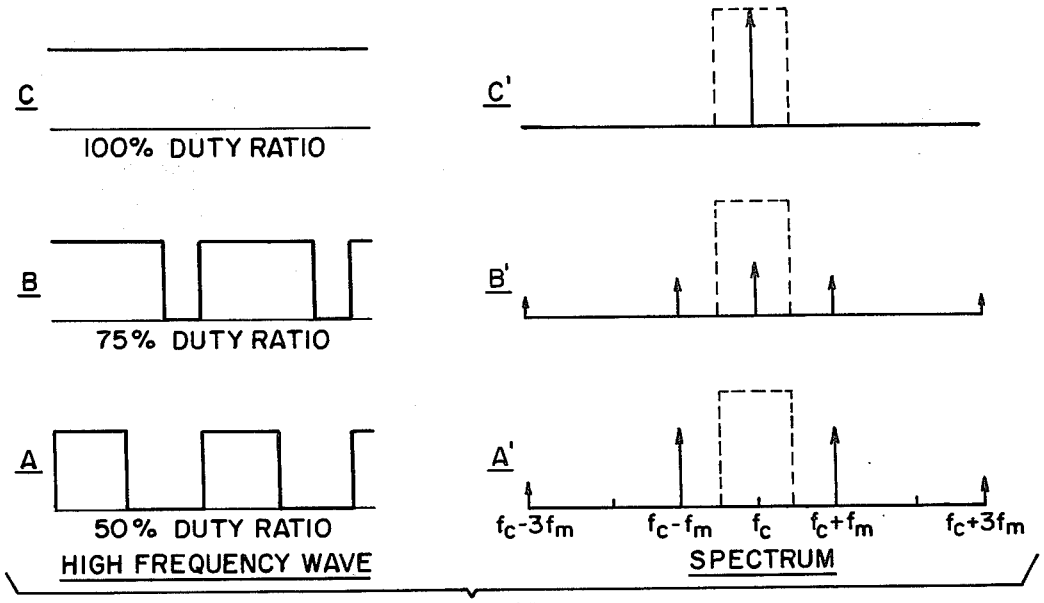
FIG. 17 illustrates the signal spectrum generated for selected values of the duty ratio of the pulse width modulation signals.

The frequency domain of such a modulation without pseudo-noise coding is represented in FIG. 2, where $f_c$ is the carrier frequency and $f_m$ is the modulation frequency. The frequency spectrum illustrated in FIG. 2 represents the theoretical condition where the modulation frequency is a square wave with half duty ratio to give an ideally suppressed carrier spectrum. Particular note should be taken of the fact that the representation in FIG. 2, and graph (A') of FIG. 17, is for the unique condition where the duty ratio is 50%, that is, where the length of the pulses are exactly equal to the distances between the pulses in terms of time. For this unique case it will be noted that the pulses and spaces of of equal length when the pulses at alternate zero and $\pi$ radians phases cause the adjacent successive pulses of carrier to mutually oppose and cancel each other and thus causes the carrier amplitude to be zero and leaving all of the signal power in the sidebands. By far the greater proportion of that signal power will be within a bandwidth which is equal to 2 times the modulation frequency, that is, $2f_m$ the band being centered on the carrier, $f_c$, as illustrated in FIG. 2.

Figure 3:
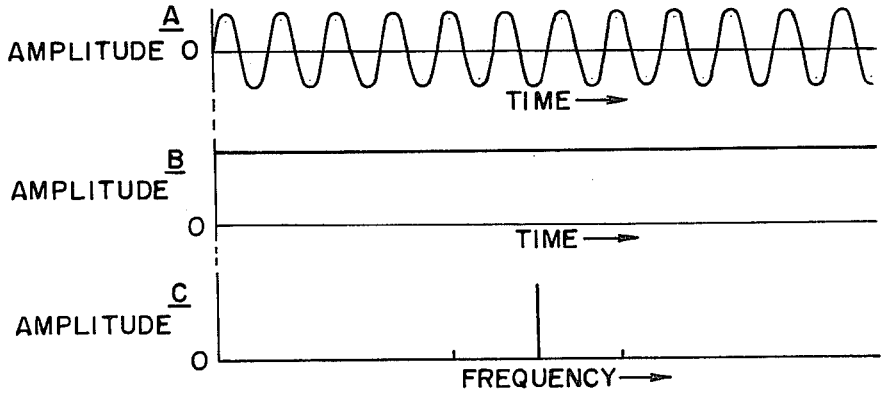
FIG. 3 illustrates that as the duty ratio is changed to 100%, there is effectively no PSK modulation of the carrier in this state and as a result all of the energy is in the carrier.

Taking the other extreme condition where there is no digital modulation (100% duty ratio) applied, that is, where $f_m = 0$, see graph (c') of FIG. 17 no sidebands exist and all of the energy is in the carrier, this condition being more specifically illustrated in FIG. 3. The first thing that will be noticed here is that the signal power varies between the carrier and the sidebands in accordance with the variation in the duty ratio of the square wave modulation.

Figure 4:
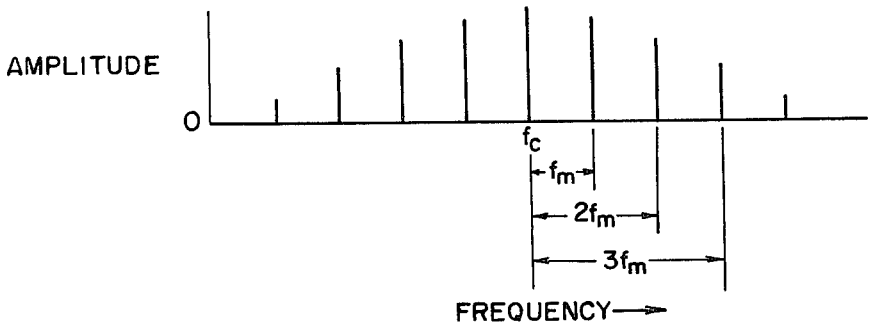
FIG. 4 is a representation of the frequency spectrum when the duty ratio is 75%, midway between the two extremes of zero and 100% modulation.

To take an intermediate point between 50 and 100% duty ratio it will be seen that for a duty ratio of 75% see graphs (B), (B') of FIG. 17 the spectrum will appear as illustrated in FIG. 4 where the energy is equally divided between the carrier and the sidebands. In all the cases given above the transmitted signal is a constant amplitude carrier. There appears a constant amplitude carrier which has its phase only perturbed by pulse sequence which has its width varied.

As the duty ratio increases toward 100% the amount of signal power in the carrier increases and for the condition of 75% duty ratio it will be seen that if a conventional AM receiver was selectively chosen such that its bandwidth is less than $2 \times f_m$ the output of the AM receiver will be a function of the duty ratio of the PWM wave train. The duty ratio being varied, by intelligence signals provides an AM intelligence component in the limited bandpass characteristic of the AM receiver. Any AM receiver with the required limited bandpass could now demodulate and extract the intelligence. However, in order to prevent interception of the intelligence component by unauthorized persons, a PN code is introduced into the PWM spectrum to make it practically impossible to recover the intelligence without proper synchronous correlation with the transmitted signals.

Figure 7:
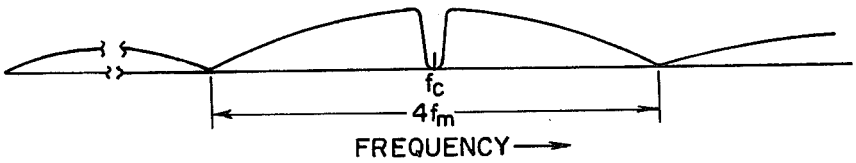
FIG. 7 is a graphical representation of the envelope of the spectrum propagated from the antenna when the modulated carrier spectrum illustrated in FIG. 6 is further modulated by a psuedo-random noise code in accordance with the present invention, indicating that the power spectrum of FIG. 6 is widely spread with the amplitude of the center lobe greatly diminished and the signal energy therein further spread out in the center lobe and into the outer sidebands.

To this end, in addition to the PWM modulation, a pseudo-noise pulse code modulation is modulo-2 added to the PWM which makes the resultant PSK carrier spectrum extremely complex and spreads the signal power under all conditions further into the outer wings of the spectrum, as illustrated in FIG. 7, so that there is substantially no signal power within the band of the conventional receiver.

Theoretically, the sidebands of a frequency modulator carrier extend substantially to infinity and when a modulation signal increases in speed the bandwidth increases and therefore the energy level of the spectrum becomes smaller and smaller and approaches conditions where the spectrum may be completely obscured in the conventional receiver thermal noise. The signal spectrum also can extend well beyond the limits of practical signal channels. In the present invention the signal intelligence is so distributed that there is substantially no usable signal power within the aperture of the conventional receiver.

Figure 8:
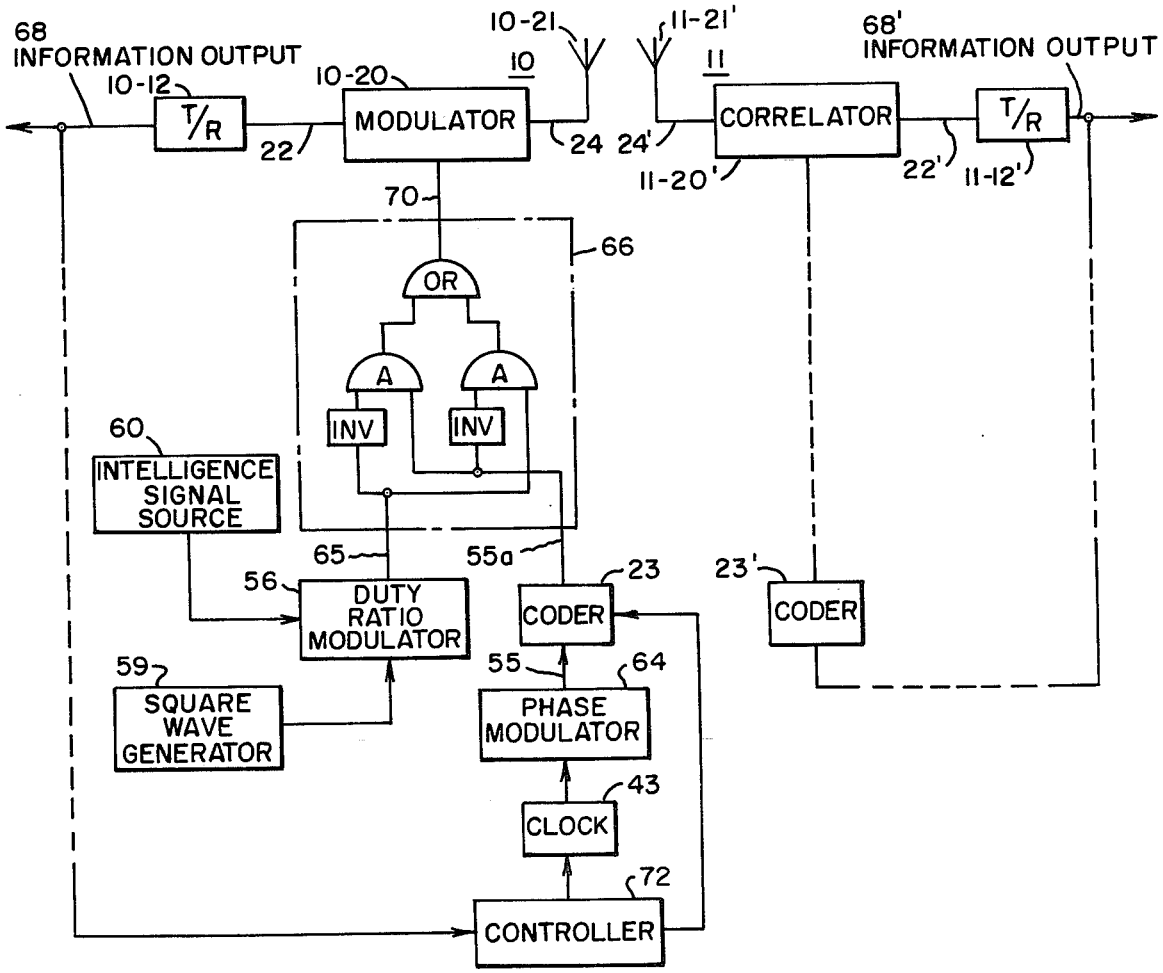
FIG. 8 is a block circuit diagram of one embodiment of so much of two identical communication units of the present invention as are involved in the transmitting mode of operation.

Referring now to FIG. 8, it will be assumed that the left-hand unit 10 is operating in the transmitting mode and is shown in somewhat greater detail than the block circuit diagram of the other unit 11 on the right-hand side of the drawing which is operating in the receiving mode. In this figure only the block circuit configuration for the unit 11 for maintaining synchronization and correlation of the receiver with the transmitter is illustrated. In the description it is believed that a meaningful description of the transmit mode of the system can be combined with the description of the operation.

In spite of the complexity of the spectrum created by the different modulations described above, the signal intelligence can be recovered in accordance with the present invention very accurately by correlation techniques which holds the modulation operation of the modulator module of the transmitter in accurate step with the correlator operation of the modulator module of the receiving unit to unscramble the complex coded signal by completely recovering the signal spectrum without the PN and thereby allowing the receiver to reproduce very faithfully the original intelligence signal. This is the essence of the invention. Since each communication unit must have both transmit and receive capabilities it is necessary to describe only a single transmitter mode and receiver mode in detail.

Figure 14:
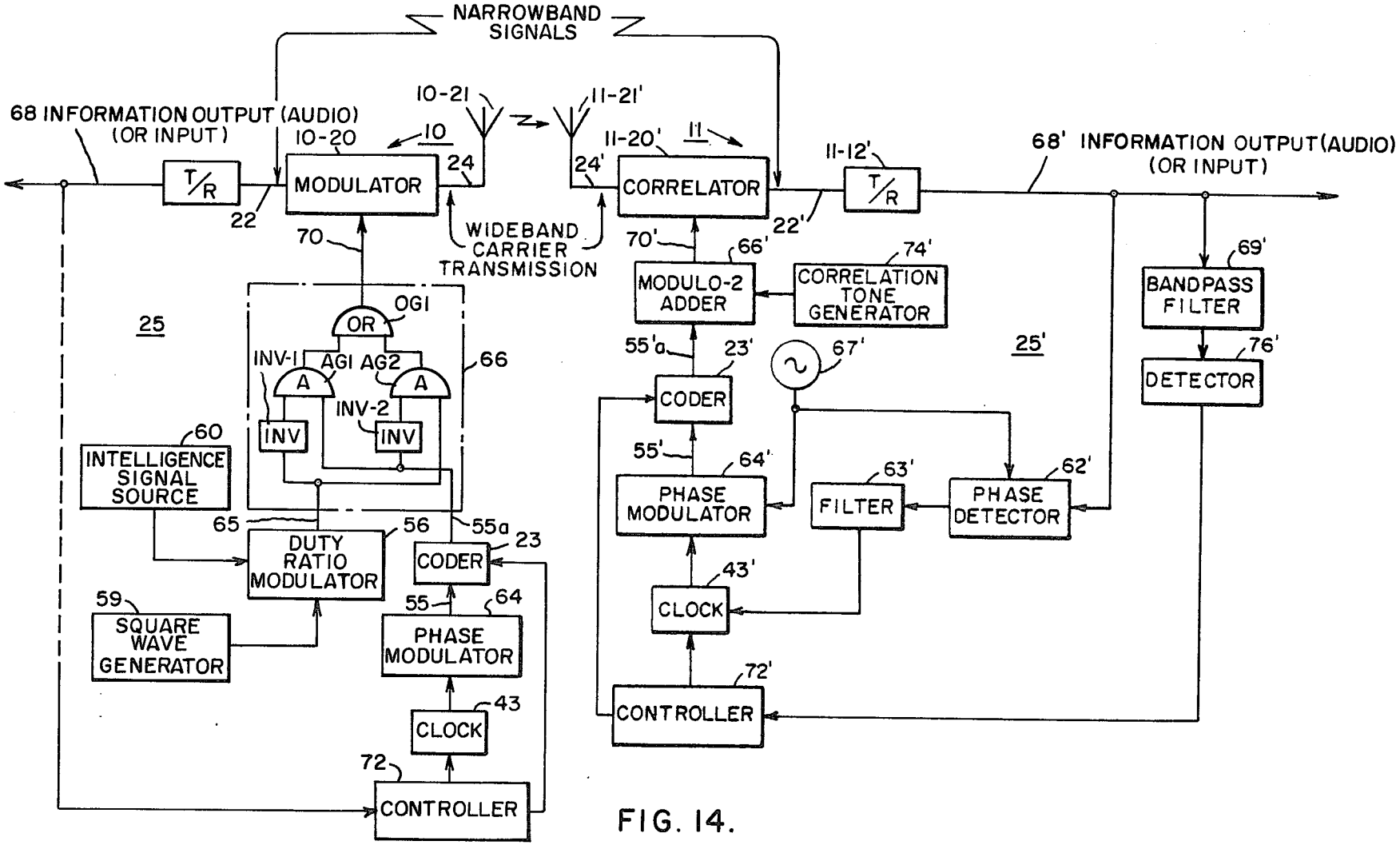
FIG. 14 is a modular block circuit diagram of a communication system in accordance with the present invention and in which the two units are identical but only so much of each unit is illustrated as enters into the mode of operation described for transmitting from the left-hand unit to the right-hand unit and for receiving in the right-hand unit during which the synchronizing and tracking loop for controlling the pseudo noise coders comes into operation.
Figure 15:
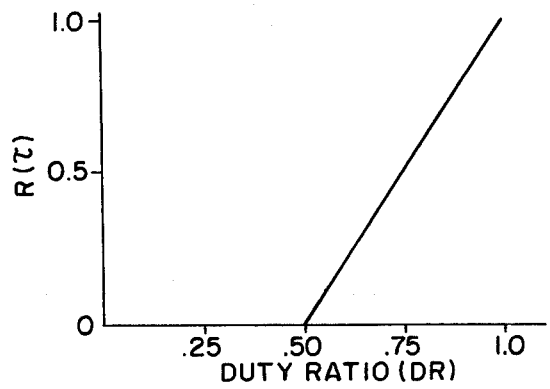
FIG. 15 is a graphical representation of the relation between the amplitude of the correlation function R as a function of ($\tau$) and the duty ratio modulation.

Now additionally referring to FIG. 14, the transceiver module 10-12 is connected by suitable electrical conductor 22 to the modulator module 10-20 over which the unmodulated carrier is supplied to the modulator module when the unit 10 is operating in the transmit mode and over which the reconstructed received carrier intelligence modulation is supplied to the information output terminal 68 from the transceiver module 10-12 when the communication unit 10 is operating in the receiver mode.

When the communication unit 10 is operating in the transmit-mode the complex modulation signals varying in the time domain although derived from pulse width modulation by intelligence signals, as previously described, is applied to the transmitter carrier by means of the module 10-20. The modulated carrier output of the module 10-20 on the conductor 24 is supplied to the antenna 10-21. The transmitted carrier signals are received by the antenna 11-21' and is supplied over conductor 24' to correlator module 11-20' of communications unit 11 which is the counterpart of module 10-20 where the signals are decoded.

The pseudo random noise modulation signal is generated by the coder 23, which, as previously mentioned, is basically a shift register and is capable of very fast operation. The output of the coder 23 is a pseudo random sequence which is nearly random and has a very long term repetition pattern. For all practical purposes this code can be made so complex that it would be very difficult for an unauthorized user to demodulate the intelligence but on the other hand, with proper synchronization and correlation means can be very readily decoded so that the spectrum of the decoded signal can be completely demodulated to reproduce very faithfully the original intelligence.

The module 10-12 and the antenna 10-21 are closely associated with the output of the pseudo random coder 23 which codes the signals in the transmitting mode and is further associated with a synchronization and tracking loop means 25, 25' when in the receiving mode to provide the necessary correlation between the transmitter and the receiver. The modulator module 10-20 is bi-directional, that is, the input terminals and output terminals are interchangeable and it will therefore not correlate with an incoming signal not properly coded entering the module from either set of terminals. This then gives it automatic discrimination against man-made interference, static or improperly coded signals.

To communicate intelligence by means of an RF carrier between the two units 10 and 11 of the communication system when one unit is operating in the transmitter and the other is operating as a receiver, there must be some means between the transmitting unit and the receiving unit for sychronizing and correlating codes in the transmitter and receiver so that the spread spectrum will be removed at the receiver end and duplicate that which existed before the complex modulation was applied to the transmitted carrier. This is the function of the synchronizing and tracking loop 25' which includes the coder 23', the modulator module 11-20' and the receiver portion of the transceiver 11-12'. This will be described later in more detail.

Figure 9:
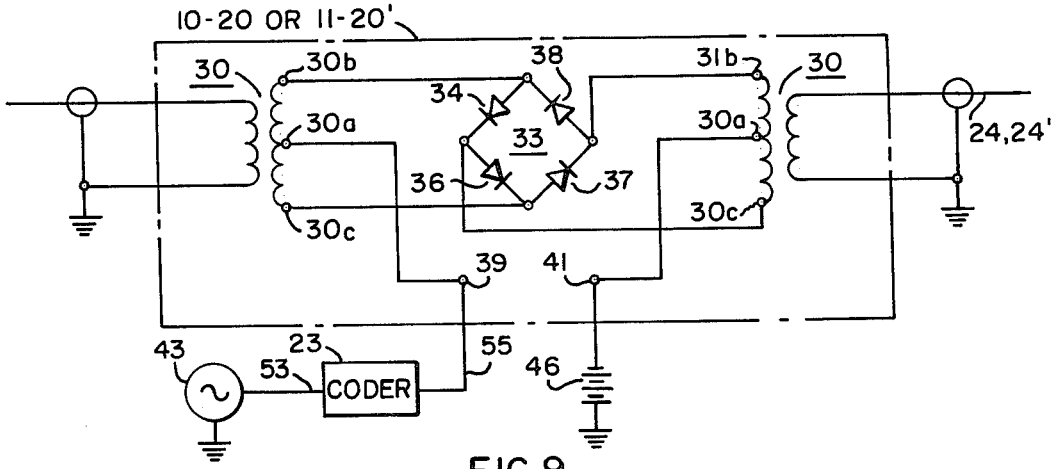
FIG. 9 is a simplified block diagram of a phase shift keyed (PSK, or phase reversal) modulator which may be used in accordance with the present invention.

An example of the modulator modules 10-20 and 11-20' for carrying out objectives of this invention is illustrated in FIG. 9. A pair of transformers 30 and 31 each have a secondary with respective center taps 30*a* and 31*a*, respectively. The end terminals 30*b*, 30*c*, 31*b* and 31*c* of the secondaries of the transformers are coupled to the conventional diode balanced ring modulator 33 having the diodes 34, 36, 37 and 38. When the appropriate bias voltage is applied across terminals 39 and 41 the balanced modulator 33 serves like a double-pole, double-throw switch which is capable of acting at a very fast rate, in a matter of nanoseconds, for example.

Figure 10:
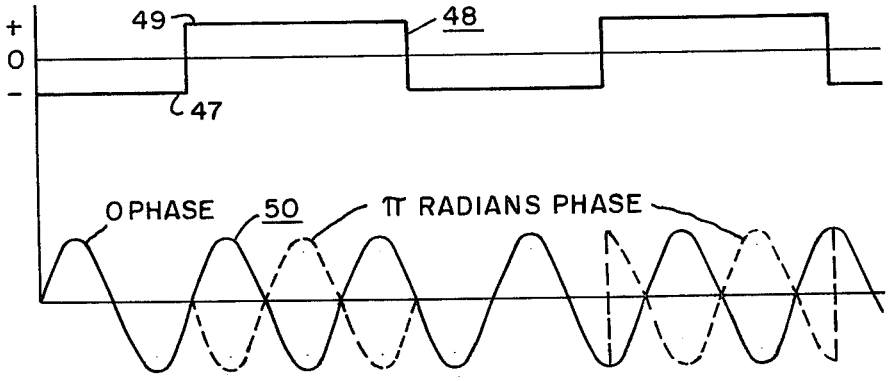
FIG. 10 illustrates the phase-reversal (PSK) modulation operation of the circuit of FIG. 9.

The biasing pulses across the terminals 39, 41 of the diode arrangement 33 are supplied by the pseudo-noise coder 23 which is triggered by clock pulses from clock pulse generator 43. The pulses supplied from the coder 23 are positive going and are superimposed on the normally fixed negative bias applied to the modulator module 10-20 by a direct current bias source, such as a battery 46. When the coder output is zero the fixed negative bias is represented by the negative lobes 47 of the square wave 48 of FIG. 10 while the positive lobes 49 represent the switched condition under the influence of the positive going output pulses from the coder 23. The lower curve 50 of FIG. 10 illustrates the relation between the PSK and the combined PN and PWM modulations previously referred to in connection with FIG. 1, for example. The negative loops 47 of curve 48 may correspond to zero phase of the carrier, illustrated by the solid line sinusoidal curve 50 while the positive loops 49 of curve 48 correspond to the shifted $\pi$ radians phase of the carrier, illustrated by the dotted line sinusoidal curve. Also, the negative modulation loops 47 represent digital zero (space) while the positive modulation loops 49 represents digital 1's (mark).

When the negative bias is applied to the diode arrangement 33, diodes 37 and 38 will be closed and the other diodes 34, 36 will be open. This, effectively, connects terminal 31*b* of transformer 31 with terminal 30*c* of transformer 30 and connects terminal 30*b* with terminal 31*c* of the transformer 31. Referring back to the curves 48 and 50 of FIG. 10, this may be assumed to correspond to zero phase as represented by the solid line portions of curve 50. When the positive pulses from the coder 23 are applied to the terminal 39 the balanced diode arrangement 33 reverses the phases between the secondaries 31 and 32 and this is represented by the phase reversal represented by the dotted line portion of the curve 50.

Figure 11:
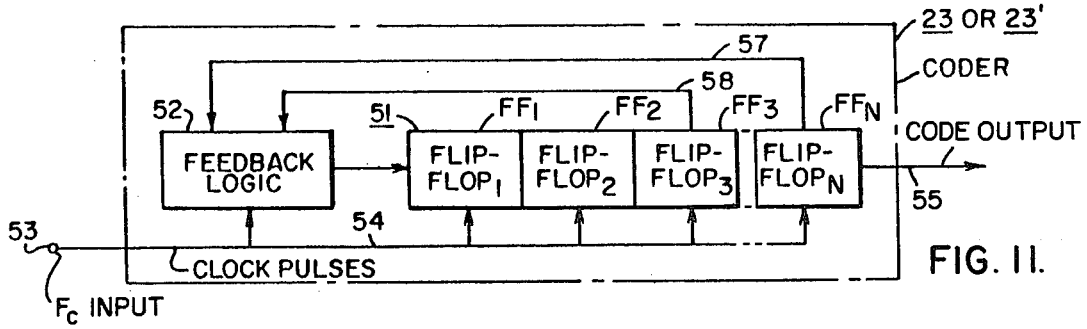
FIG. 11 is a simplified block circuit diagram of a pseudo-random binary code generator illustrative of the type which may be used in accordance with the present invention to control the phase reversal (PSK) modulation.

One version of the pseudo-random coder 23 is illustrated in FIG. 11. This may take the form of a shift register 51 comprising a plurality of flip-flop circuits $FF_1$, $FF_2$, $FF_3$, $FF_N$ coupled to a modulo-2 adder circuit 52 (feedback logic), such that the output of the modulo-2 adder is coupled to the input of the first flip-flop stage $FF_1$. Clock pulses from a clock generator 43 are supplied to a terminal 53 and through the common bus 54 of the modulo-2 adder 52 to all of the flip-flop stages.

To produce a pseudo-random code with a shift register it is necessary only to supply a feedback from one of the stages other than the last one to the input of the register. As an example, the output from the flip-flop stage $FF_3$ is fed back to the modulo-2 adder 52, constituting a feedback logic network, through a conductor 58 and these two feedback loops to the modulo-2 adder 52 generate a pseudo-random noise code which will be a long code that may be generated for a great length of time without repeating any given sequence. The code generated will be repetitive within the predetermined code length N, that is, the number of bits in the code is determined by the expression $N = 2^P - 1$ where $P$ is the number of stages in the shift register.

One bit in the code is defined as the smallest pulse width, "T," capable of being generated. It is also equal to the reciprocal of the clock pulse frequency which in this case is the clock frequency $F_c$ that is, $T = 1/F_c$ which is used to drive the shift register 51. The clock pulses from the clock pulse generator 43 are supplied to the input terminal 53 of the coder 23 and since flip-flop stages are utilized the code length N will be $N = 2^4 - 1 = 15$.

The coder 23 is so connected to the modulator module 10-20 by conductor 55*a*, through a modulo-2 adder 66. The PWM digital signal will then, in a controlled manner, select the coder output or its complement, depending upon the state of the PWM signal for the purpose of producing a spread spectrum in which all the sidebands are noise-like sidebands. The modulo-2 adder 66 is connected to the modulator module 10-20 by the conductor 70.

Figure 5:
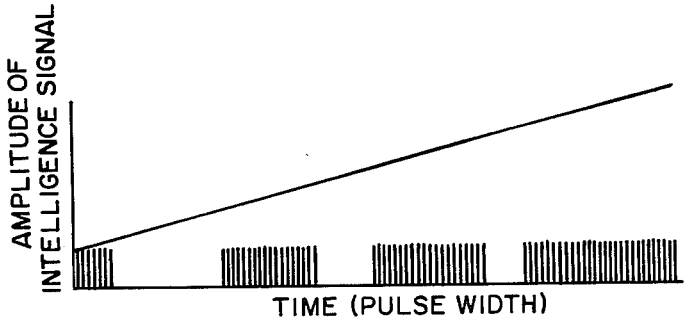
FIG. 5 is a graphical representation of the relation between the amplitude of the intelligence signal voltage and the pulse width of the pseudo-random noise modulation superimposed upon the phase reversal modulation, the pulse width being modulated in accordance with the amplitude of the signal intelligence.

The modulo-2 adder 66 includes two AND gates $AG_1$, $AG_2$ and an OR gate $OG_1$. The conductor 65 from the duty ratio modulator 56 goes to one side of the gate AG1 and to the complemental side of gate AG2. The output of the intelligence signal source 60 is supplied to the duty ratio modulator 56 and it provides pulse width modulation of the signals supplied by the square wave generator 59 to the duty ratio modulator. The relation between the amplitude of the intelligence signals and the pulse width is illustrated in FIG. 5. The relation is illustrated as being linear although it need not be.

The output from the coder 23 on conductor 55*a* constitutes the other input signal to the modulo-2 adder 66. In this instance, the modulo-2 adder is in the form of an "exclusive/OR" circuit. Whereas the output from the coder 23 is connected through the conductor 55*a* directly to one side of one of the AND gates and through an inverter INV-2 is connected to the complemental side of the other AND gate, the output from the duty ratio modulator on conductor 65 is connected directly to the complemental side of one of the AND gates and through an inverter INV-1 to the other gate AG1. The outputs of the gates AG1 and AG2 are supplied to the OR, gate OG1. The output from the OR gate is also the output from the modulo-2 adder 66 which is supplied over conductor 70 to the modulator module 10-20.

Figure 12:
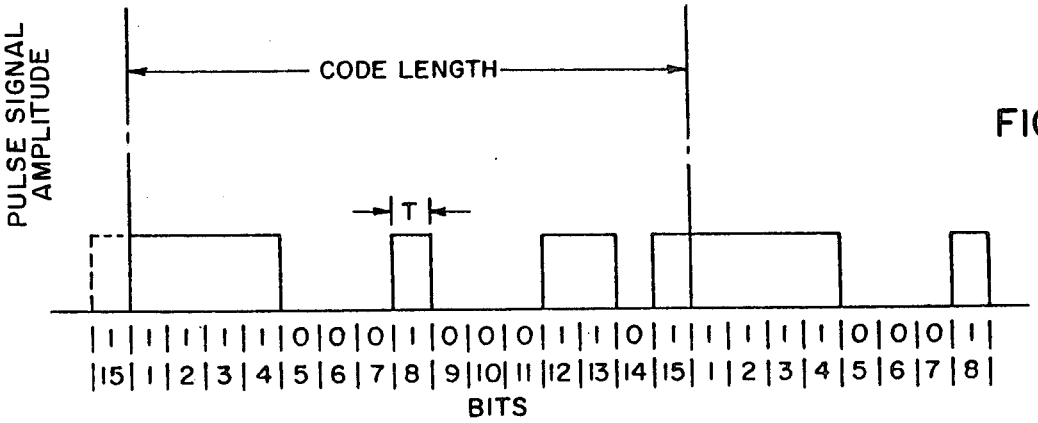
FIG. 12 is a graphical illustration of a fifteen bit long binary digital code.
Figure 13:
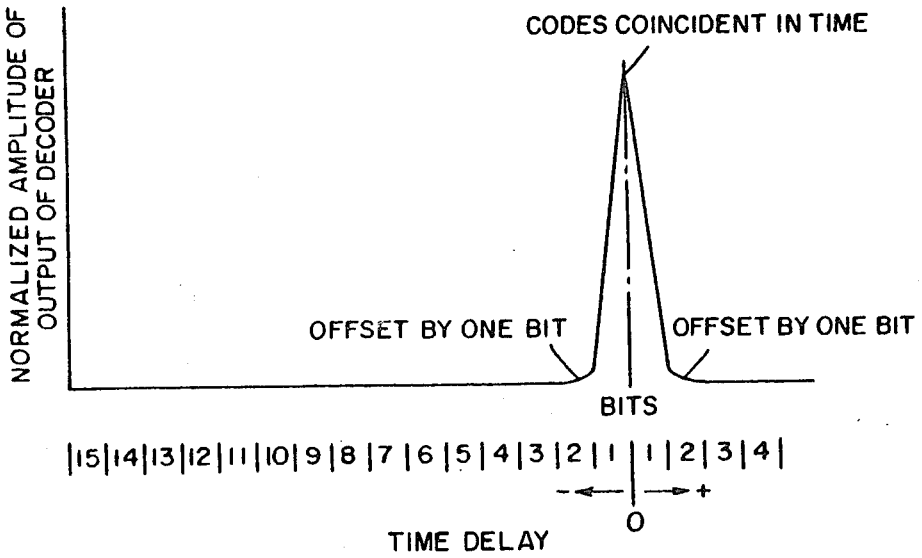
FIG. 13 is a graphical representation of the correlation function with the output of the correlator plotted as ordinants and the relative time delay in bits plotted as the abscissa.
Figure 16:
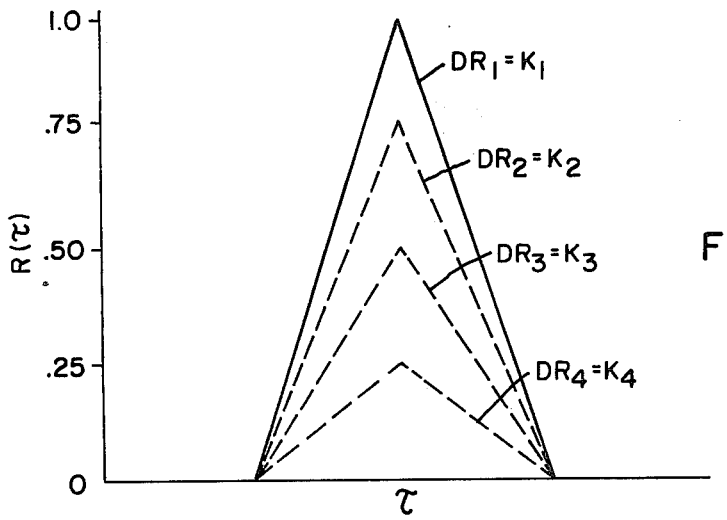
FIG. 16 is a graphical illustration of the auto correlation function for different values of duty ratio modulation as a function of time ($\tau$)

Now assuming that in the initial condition the output of all the flip-flop stages of the register 51 of the coder 23 is a binary ONE, the code produced when the series of clock pulses is applied would be, for example, that as indicated in FIG. 12. This figure illustrates a binary pulse code of binary ones and zeros having a length of 15 bits. The waveform indicative of the code has a value of binary ONE for the first four bits and the value of binary ZERO for the next three bits. The width of a single bit is indicated at "T." When this code is compared or matched against itself in the correlating decoder 23 in the communications unit 11, operating in the receive mode, a characteristic called the auto-correlation function is produced. FIG. 13 is a diagram illustrative of the auto-correlation function assuming zero information signal input. The curve is drawn by applying the amplitude of the output of the decoder, that is, the output of coder 23' of the unit 11, (which serves as a decoder when operating in the receive mode) against the relative time delay in bits of the two input codes. The two codes in the present instance are first, the one which is in the transmitted signal and is received by the antenna 11-21' and is supplied to the correlator module 11-20' and, second, the signal supplied over conductor 70' to the correlator module 11-20'. It can be seen that when the codes are coincident in time, the output is the maximum. However, as the codes move away from coincidence the amplitude falls off very rapidly since that for a one bit time delay the output goes to zero immediately. It must be understood that FIG. 13 represents the condition for an arbitrarily assumed instantaneous value of the coded signal function. FIG. 16 represents how this value varies up and down as a function of the duty ratio and as a function of time, which in turn is proportional to the amplitude of the information signals. A very important point to be stressed here is the fact that this variation in the amplitude of the information signal is in the phase modulation of the signal and that there is no corresponding variation in the amplitude of the transmitter carrier.

During the transmit mode of operation the pulse width and the phase of the complex modulation components of the transmitted carrier are generated by the combined action of the coder 23 and the output of the duty ratio modulator 56 which is width modulated by the intelligence signals. To this end, intelligence modulated PWM pulses from the duty ratio modulator 56 on the conductor 65 and pseudo-noise pulses from coder 23 on conductor 55*a* are modulo-2 added and the resultant signals are supplied over conductor 70 to the modulator 10-20. It is the output of the modulo-2 addition on conductor 70 that controls the modulator 10-20, which may have a circuit such as that illustrated in FIG. 9, or its equivalent. The binary ZERO output from the modulo-2 adder 66, represented by a negative bias loop 47, FIG. 10, on conductor 70, permits transmission of the RF signal at one phase which may be called zero phase, solid line curve 50, FIG. 10 and a binary ONE output, represented by positive loop 49 pulse on the conductor 70 to the modulator module 10-20 causes the phase of the carrier to be shifted 180° to $\pi$ radians phase. When such carrier energy is thus coded, transmitted, received and matched against itself, the other correlation function causes the received spectrum to be collapsed so that the final detector portion of the receiver extracts the intelligence information from the reconstituted constant amplitude carrier which has the intelligence signal buried in the code structure of the carrier.

Figure 6:
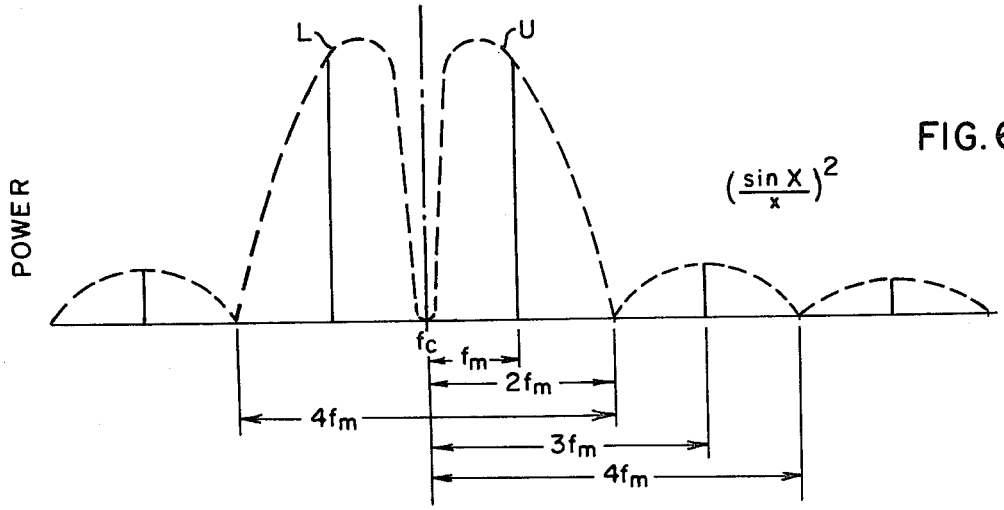
FIG. 6 is a graphical representation of the envelope of a frequency spectrum of a carrier when PSK modulated by the PWM digital signal input — this graph is similar to the curve of FIG. 2 indicating that most of the signal energy lies in the center lobe representing a 2 fmHz band centered on the carrier frequency *fc* — as the duty cycle is varied the sidebands vary with the dotted line envelope being the loci of their maximum amplitudes.

It has been shown previously that for the condition where the PWM signal and the PN signal are combined in the modulo-2 adder 66 and supplied to the modulator module 10-20 at 100% duty ratio all of the signal power will be in the carrier $f_c$ after correlation as indicated at curve C' in FIG. 17. Also, when the duty ratio is 50%, as indicated at curve A' in FIG. 17, there are discrete sidebands with the carrier suppressed after correlation. At a 75% duty ratio as at curve B' in FIG. 17, one half of the signal is in the carrier and the other half is in the discrete sidebands after correlation. The dominant part of the energy will be in a lobe centered on the carrier as shown in FIG. 6. The significant portions of the discrete sidebands are spaced above and below the carrier by an amount equal to the difference between the carrier frequency $f_c$ and the sub-carrier frequency $f_m$. The illustrated spectra shown in FIG. 17 are several example spectra that would be on line 22' of FIG. 14 after PN code correlation. Therefore, as long as the modulating frequency is spaced from the carrier frequency by an amount greater than one-half of the receiver bandpass characteristic, the receiver can demdulate the intelligence by a conventional amplitude detector. A receiver without the proper correlation process cannot demodulate the intelligence with any form of demodulator.

It should be understood that the modulator block circuit diagram of the two identical communications units 10 and 11 in FIG. 14 that constitute a complete communication system are merely illustrative. The units are identical, only those components are illustrated for each unit which enter into the respective modes of operation for each other with the left-hand unit operating as a transmitter and the unit on the right operating as a receiver. It should be also noted that the arrangement of the RF circuits and the modulator-correlator module between the transmitter and antenna is shown for illustrative purposes. The sequence could be rearranged so that the RF power amplifier could be accomplished after modulation and the correlator function could be contained in the IF section of the receiver.

The two units 10 and 11 can be identical because the modulator-correlator modules 10-20 and 11-20' are bidirectional and can demodulate a properly coded incoming signal or they can modulate and expand to a pseudo-random code spectrum any incoming signal which is not properly coded. Since each of the communication units has a transceiver module it is apparent that when each unit is operating as a transmitter its receiver components are inactive, and vice versa. That is the basis for the manner of the presentation of the description of the invention.

To complete the description of the system it is now necessary to describe the means for maintaining synchronization and correlation between the transmitting unit and the receiving unit. This requires that the clock at the receiving end track the clock at the transmitting end in order to maintain synchronization automatically. The present invention is capable of achieving very large spreading ratios and therefore it is apparent that the pseudo-random coders 23 and 23' are capable of very high speed operation. In order to accomplish this it is apparent that means must be provided to determine the code rate and to maintain the proper synchronization between the code transmitted from the transmitter of one unit and that generated at the receiver of the other unit for accomplishing the foregoing purposes.

Referring again to FIG. 14, with the left-hand unit 10 operating in the transmit mode the carrier generated by the transmitter of the transceiver module 10-12 is supplied to the modulator module 10-20 where the carrier is modulated by the complex signals derived from the information-modulated PWM signal and the PN signal generating a typical PSK spectrum. In both units a clock pulse generator 43 in the transmitting unit and the generator 43' in the receiving unit responds to controllers 72, 72' respectively which determine the code rate and also performs the synchronizing function.

The radio frequency carrier, after being modulated by the complex modulation signal in the modulator module 10-20 is radiated from the antenna 10-21. The information is contained in the correlation characteristic of the phase-reversal modulation. To this end, the square wave generator 59 supplies pulses to the duty ratio modulator 56 while information signals from the information signal source 60 modulates the width of the pulse signals as a function of the amplitude of the intelligence signals. The pulse width modulation signals are modulo-2 added in the modulo-2 adder 66 to the pseudo-random noise signals from the pseudo-random noise (PN) coder 23, driven by the clock pulse generator 43 to produce either the code or the code complement as previously described.

An analog of the modulo-2 adders 66 would be a single-pole, double-throw switch with the inputs being supplied by the code and its complement of th coder 23. The switching frequency is controlled by the duty ratio modulator 56. The coded signal output from the adder 66 on the conductor 70, leading to the input of the modulator 10-20, phase-reversal modulates a radio frequency carrier which is radiated from the antenna 10-21. The result is a constant amplitude carrier which is phase-reversal modulated by the combined PWM and PN digital signals. The frequency spectrum distribution is a function of the pseudo-random code added to the pulse width modulation.

In the description so far, synchronization and correlation has been assumed for the purpose of simplification of the description of the significant features of the invention. Now the operation of the synchronization and correlation of the transmitter and receiver will be described. In the subsequent description the prime numbers indicate that the components are operating in the receiving mode in the right-hand communication units 11 which are counterparts of components in the unit 10, operating in the transmitting mode, although they may or may not be active in the transmitting mode in the unit.

The communication unit 11, operating in the receiving mode, receives the wide band radiated carrier and routes it through the correlator module 11-20' in the direction opposite to the relative direction that the signals pass through the modulator module 10-20 of the other unit 10. Because of the bidirectional characteristics of the correlator module 11-20, the latter component operates as a correlator when the proper code is supplied to the module 11-20' while simultaneously receiving signals in that code, assuming now that the codes 23 and 23' are in time synchronism. Under this condition the correlator module 11-20' will reinvert the phase of the received RF carrier from the PN component of the phase-reversal modulation applied in the modulator module 10-20 at the transmitter 10. As a result, the carrier spectrum is correlated and this collapses the spectrum to that which existed before being pseudo-noise modulated in the modulator module 10-20 leaving the frequency components of the duty ratio modulator as shown in FIG. 17. The receiver component of the transceiver 11-20' can detect the information from the AM modulation on the correlated carrier spectrum, or the reconstituted carrier, in a conventional manner.

It is apparent that in order to collapse the spectrum and reconstitute the received radio frequency carrier and its modulation frequencies that a practical means for maintaining tracking and correlation between the coders and the transmitter and receiver respectively is necessary in order to maintain synchronization automatically. This is accomplished by a tracking loop 25'. This tracking loop includes the modulator module 11-20', the receiver of the transceiver module 11-12', conductor 68', a phase detector 62', a filter 63', the clock generator 43' a phase modulator 64', a coder 23' and the modulo-2 adder 66'. The action of the loop 25' is modified by another closed loop including a local oscillator 67' supplying a reference frequency signal to the phase detector 62' and the phase modulator 64'.

The tracking loop 25' just described maintains synchronization of the receiver coder 23' with the transmitter code generated by the coder 23. Correlation is maintained by a closed loop that includes the correlator module 11°', the receiver of the transceiver 11-12', the output conductor 68' of the receiver, a bandpass filter 69', centered on the frequency of the correlation tone generator 74'; a detector 76', a controller 72', the clock-pulse generator 43', the phase modulator 64', to which is supplied a reference frequency by the reference oscillator 67', the coder 23' and the modulo-2 adder 66' which also receives a tone signal from correlation tone generator 74'. It is believed unnecessary to show all the details of the controller 72' in the interest of avoiding unnecessary complexity of the circuitry since it would not add to the understanding of the invention. Basically, the controller 72' changes the circuit configuration from transmit to receive, and vice versa. One skilled in the art can readily supply the appropriate circuitry and instrumentation from the functional description.

Since it will be apparent that tracking and correlation of the coders at the transmitter and receiver, respectively, is necessary for communicating information, the controller 72' is so constructed and instrumented that signals can be sent to the coder 23' to cause it to advance and retard to search out all possible code positions until correlation is effected. The above is merely an example of one type of control which might be used. Others will occur to those skilled in the art. At the instant of synchronism there is a zero delay on the corresponding correlation function curve which results in an increase in the receiver output signal, see FIG. 13, and a side tone from the generator 74' is detected since correlation will then exist between the coders 23 and 23'. This side tone signal is then detected by detector 76' to provide a control voltage to cause the search function to cease and to switch the receiver of a communications unit 11 to the track mode. Upon synchronization the receiver coder 23' will continue to track the transmitter coder 23 so that the transmission and reception of the information takes place.

It will be seen from the foregoing description that the operation of the present invention can be analyzed on the basis of the conventional truth table for binary digit operations. Therefore, it is immaterial which side of a flip-flop stage of the coder 23 is used as the coder output on conductor **55*a* to the modulo-2 adder 66. In either event the input from conductor 55*a*** will be alternately coded and code complement. This will particularly distinguish this invention from another related invention by applicants herein where the binary digit truth table does not apply.

What is claimed is:

1. In a signalling system, means for generating a carrier wave, means for generating square wave pulses, means for modulating the duty ratio of said square wave unit in accordance with the amplitude of intelligence signals, means for generating code signals, means for modulo-2 adding the output of said duty ratio modulating means with the output of said code generating means, means for phase modulating said carrier and means responsive to the output of said modulo-2 adding means for controlling said phase modulating means.

2. A signalling system as set forth in claim 1 in which said phase-modulation means produces phase-reversal modulation.

3. A signalling system as set forth in claim 1 in which said code signals are pseudo-random noise.

4. A signalling system as set forth in claim 2 in which said code signals are pseudo-random noise.

5. A signalling system as set forth in claim 1 in which said code is pseudo-random noise, and includes means connected between said pulse generator and said modulo-2 adding means for alternatively supplying a code and the code complement to said modulo-2 adding means.

6. In a signalling system, means for generating a carrier wave, means for generating a stream of square wave pulses, means for varying the width of said pulses in accordance with the amplitude of intelligence signals, means for phase modulating said carrier in accordance with the modulo-2 adder sum of said stream of square wve pulses and the output of said pulse width modulation means to thereby provide a constant amplitude spectrum whose signal power varies in the frequency or phase domain and not in the amplitude domain.

7. A signalling system as set forth in claim 6 in which said means for generating a stream of square wave pulses includes a periodic square wave pulse generator, a duty ratio modulator operably connected to said square wave pulse generator, a pseudo-random noise generator and modulo-2 summing means for summing the output of said duty ratio modulator and said pseudo-random noise generator.

8. A signalling system as set forth in claim 7 plus a receiver, a clock pulse generator for triggering said pseudo-random noise generator, a phase modulator connected between said clock pulse generator and said pseudo-random noise generator; a synchronizing servo loop including said receiver, a phase detector connected to the output of said receiver, a filter connected between said phase detector and said clock pulse generator, said clock pulse generator, said phase modulator, said pseudo-random noise generator, said modulo-2 summing means and said carrier modulating means; and a reference oscillator for supplying a reference frequency to said phase detector and said phase modulator.

9. A signalling system comprising a unit for generating and modulating a carrier wave including a periodic square wave pulse generator, a duty ratio modulator operably connected to said square wave pulse generator, a pseudo random noise generator and modulo-2 summing means for summing the output of said duty ratio modulator and said pseudo random noise generator and a second unit for receiving and correlating a carrier wave including a periodic square wave pulse generator, a duty ratio modulator operably connected to said square wave pulse generator, a clock pulse generator for triggering said pseudo random noise generator, a phase modulator connected between said clock pulse generator in said pseudo random noise generator, a modulo-2 summing means for summing the output of said duty ratio modulator and said pseudo random noise generator; a synchronizing servo loop including said receiver, a phase detector connected to the output of said receiver, a filter connected between said phase detector and said clock pulse generator, said clock pulse generator, said phase modulator, said pseudo random noise generator, said modulo-2 summing means and said carrier modulating means; and a reference oscillator for supplying a reference frequency to said phase detector and said phase modulator.

10. A signalling system as set forth in claim 9 plus a tracking loop including a bandpass filter connected to the output of said receiver, a detector and a controller connected between said detector and said clock pulse-generator for maintaining synchronization and tracking or correlation between said pseudo-random noise generator and a coded incoming signal.

* * * * *